US005737933A

United States Patent [19]

Idei et al.

[11] Patent Number: 5,737,933

[45] Date of Patent: Apr. 14, 1998

[54] ABSORPTION REFRIGERATING MACHINES GROUP APPARATUS

[75] Inventors: Nobuhiro Idei, Ohra-gun; Yasuo Sakata, Kasukabe; Hideaki Oana; Yuichi Suzuki, both of Gunma-ken, all of Japan

[73] Assignee: Sanyo Electric Co., Ltd., Osaka-fu, Japan

[21] Appl. No.: 677,592

[22] Filed: Jul. 9, 1996

[30] Foreign Application Priority Data

Jul. 11, 1995 [JP] Japan ..... 7-175191

[51] Int. Cl.[6] ..... F24B 15/00

[52] U.S. Cl. ..... 62/141; 62/142

[58] Field of Search ..... 62/101, 141, 142, 62/146, 144, 476

[56] References Cited

U.S. PATENT DOCUMENTS

| | | | |
|---|---|---|---|
| 3,301,000 | 1/1967 | Holbay | 62/141 |
| 5,282,369 | 2/1994 | Ohuchi et al. | 62/476 |
| 5,363,668 | 11/1994 | Nakao et al. | 62/141 |

FOREIGN PATENT DOCUMENTS

| | | | |
|---|---|---|---|
| 2108399 | 4/1990 | Japan . | |
| 4254162 | 9/1992 | Japan . | |
| 4283341 | 10/1992 | Japan . | |
| 4288435 | 10/1992 | Japan . | |
| 406082115 | 3/1994 | Japan | 62/144 |

*Primary Examiner*—William Doerrler

*Attorney, Agent, or Firm*—Weingarten, Schurgin, Gagnebin & Hayes LLP

[57] ABSTRACT

An absorption refrigerating machines-group apparatus that can be installed at reduced cost and prevent the occurrence of abnormal situations due to the unexpected suspension of the operation of a cooling water pump is provided. The absorption refrigerating machines-group apparatus according to the invention comprises a control panel 200 for issuing control signals, an adapter 300 having a control section 310 for relaying control signals and absorption refrigerating machines 100A, 100B, 100C having respective control sections 80, said control sections 310 and 80 being connected by a telecommunications line L51. When a signal for suspending the operation of the shared cooling water pump is relayed, the currently operating absorption refrigerating machines are brought into a temporary state that allows the operation of the cooling water pump P2 to be suspended through an exchange of signals between the control sections 310 and 80. After obtaining a "pump suspension signal" from each and every one of the absorption refrigerating machines, the control section 310 suspends the operation of the cooling water pump P2. The control section 310 can also suspend the operation of the cooling water pump P2 by seeing the signal representing the operation of the value-setting section 330 and determining if the pump sharing arrangement or the individual pump arrangement is currently selected.

2 Claims, 10 Drawing Sheets

ABSORPTION REFRIGERATING MACHINES GROUP APPARATUS

BACKGROUND OF THE INVENTION

1. Field of the Invention

This invention relates to a group of apparatus (referred to as an absorption refrigerating machines group apparatus for the purpose of the invention) comprising a plurality of absorption refrigerating machines arranged at respective required positions, a remotely arranged general control panel (referred to as control panel for the purpose of the invention) and a relay device (referred to as adaptor for the purpose of the invention) disposed between said refrigerating machines and said control panel for relaying an operation control signal for controlling the operation of a pump connected to each of said absorption refrigerating machines by piping.

2. Background Art

Absorption refrigerating machines of the type under consideration include an absorption refrigerating machine 100 that has a configuration as shown in FIG. 6 of the accompanying drawings and utilizes an absorption liquid which is an aqueous solution of lithium bromide obtained by mixing lithium bromide operating as absorbent and water operating as refrigerant.

In FIG. 6, the solid lines indicate liquid pipe lines for transporting refrigerant solution, absorbent solution, cooling water and so forth and the thick solid line indicates a vapor pipe line for refrigerant vapor. Firstly, the circulation system for absorbent solution will be described, starting from the low concentration absorbent solution, or dilute solution 2*a*, staying on the bottom of absorber 1.

The dilute solution 2*a* is transported by a pump P1 to a high-temperature regenerator 5 by way of a pipe line 3. The high-temperature regenerator 5 is heated by a heater 6 such as a burner located below it so that the refrigerant contained in the dilute solution 2*a* evaporates to separate the heated and intermediately concentrated absorbent solution, or intermediary solution 2*b*, from the refrigerant vapor 7*a*.

The high-temperature intermediary solution 2*b* is driven to proceed further to a high-temperature side heat-exchanger 9 by way of a pipe line 8. The high-temperature intermediary solution 2*b* in the heat-exchanger 9 gives off heat to the dilute solution 2*a* passing through the pipe line 3 to become cooled and then moves further to a low-temperature regenerator 11 by way of a pipe line 10.

Since the refrigerant vapor 7*a* is sent into a radiator pipe 11A in the low-temperature regenerator 11 designed to heat the intermediary solution 2*b* by way of a pipe line 21 and hence heated there, the refrigerant contained in the intermediary solution 2*b* evaporates to separate the heated and highly concentrated absorbent solution, or dense solution 2*c*, from the refrigerant vapor 7*b*.

The high-temperature and dense solution 2*c* is then driven to proceed further to a low-temperature side heat-exchanger 13 by way of a pipe line 12. The high-temperature and dense solution 2*c* in the heat-exchanger 13 gives off heat to the dilute solution 2*a* passing through the pipe line 3 to become intermediately cooled and then moves further to a sprayer 1A arranged in the absorber 1 by way of a pipe line 14, where it is sprayed out through a number of pores bored through the sprayer 1A.

As the sprayed dense solution 2*c* flows down along the outer wall surface of a cooling pipe 1B, it absorbs the refrigerant vapor 7*c* coming in from an adjacently disposed evaporator 26 to become diluted and, at the same time, cooled by the cooling water 32*a* flowing through the cooling pipe 1B arranged in the absorber 1 to get back to a low-temperature dilute solution 2*a* to terminate the circulation of the absorbent solution.

Now, the circulation system for refrigerant will be described, starting from the refrigerant vapor 7C contained in the absorber 1. As described above by referring to the circulation system for absorbent solution, the refrigerant vapor 7*c* is absorbed by the dense solution 2*c* sprayed out from the sprayer 1A in the absorber 1 to make the latter a dilute solution 2*a* and then gets back to refrigerant vapor 7*a* in the high-temperature regenerator 5.

The refrigerant vapor 7*a* is then sent into the radiator pipe 11A in the low-temperature regenerator 11 by way of a pipe line 21, where it gives off heat to the intermediary solution 2*b* to become condensed and get back to refrigerant solution 24*a*, which then goes to the bottom of the condenser 25 by way of a pipe line 22.

The condenser 23 cools the refrigerant vapor 7*b* entering there by way of a number of flow paths 11B arranged between itself and the adjacently disposed low-temperature regenerator 11 by means of cooling water 32*a* flowing through a cooling pipe 23A in the condenser 23 and condense the refrigerant vapor 7*b* back to low-temperature refrigerant solution 24*a*. The refrigerant solution 24*a* then flows into an evaporator 26 by way of a pipe line 25 and stays on the bottom of the evaporator 26 to become refrigerant solution 24*b*.

The refrigerant solution 24*b* is then driven by a pump P3 to proceed to a sprayer 26A by way of a pipe line 28 and sprayed out through a number of pores bored through the sprayer 26A. The sprayed refrigerant solution 24*b* cools the fluid flowing through the heat-exchanger pipe 26B in the evaporator 26, which fluid is cold/warm water 35*a* returned for thermal operation. During this cooling operation, the refrigerant solution 24*b* absorbs heat from the returned cold/warm water 35*a* to become refrigerant vapor 7*c*, which is then sent back to the absorber 1 by way of a number of flow paths 26*c* arranged between the evaporator 26 and the adjacently disposed low-temperature regenerator 1 to terminate the circulation of the refrigerant.

Such a twofold regenerating operation involving the use of a high-temperature regenerator 5 and a low-temperature regenerator 11, both an absorbent solution and a refrigerant, or fluids supplied by way of a pipe line 36 for thermal operation by a heat-exchanger pipe 26B in an evaporator 26 that are returned cold/warm water 35*a*, which are cooled as they are circulated so that cooling water 35*b* is supplied to one or more than one cooling apparatus (not shown) such as room air-conditioners by way of a pipe line 37 is referred to as a double effect cooling operation or an air conditioning operation because such an operation is normally used for air-conditioning.

On the other hand, an operation of directly returning a refrigerant vapor 7*a* evaporated by a high-temperature regenerator 5 and a high-temperature intermediary solution 2*b* to be sent to a high-temperature heat-exchanger 9 by opening a control valve V1 arranged on a branched pipe line 41 and mixing a refrigerant solution 24*b* staying on the bottom of an evaporator 26 with an absorbent solution 2*a* by opening another control valve V2 arranged on a pipe line 43 branched between a pipe line 28 and another pipe line 4 to circulate both an absorbent solution and a refrigerant by operating only a high-temperature regenerator 5 without using a low-temperature regenerator 11 and, at the same time, heating the fluid supplied by a pipe line 36 for thermal operation, or returned cold/warm water 35*a*, by means of a heat-exchanger pipe 26B in the evaporator 26 so that warm water 35 is supplied as fluid for thermal operation to one or more than one heating apparatus (not shown) such as room air-conditioners by way of a pipe line 37 is referred to as a warming operation (boiler operation) or an air-conditioning operation because such an operation is normally used for air-conditioning. Note that both the absorber 1 and the condenser 23 shown in FIG. 6 are not required for such a warming operation and, therefore, the operation of the pump P2 is suspended so that no cooling water 32*a* may be fed from the pipe line 31. Also note that the pump P2 is independent from the absorption refrigerating machine 100 and connected to the absorption refrigerating machine 100 by piping as shown in FIG. 6.

Additionally, there is a control section 80, which is a microcomputer based control section comprising a CPU as a principal component as shown in FIG. 7, which may be a commercially available CPU mother board, and designed to receive various detection signal obtained by detecting the states of various component sections of the refrigerating machine and various operation signals obtained by operating various value-setting sections 70 by way of an input/output port 81, or an input/output interface, of the control section 80, temporarily store them in a working memory 83 of the control section 80, produce various control signal obtained by carrying out predetermined arithmetic processing operations, using programs stored in a processing memory 82 for control operations, reference data on temperature and other parameters and time data on latency time and others to various working member to be controlled by way of the input/output port 81 and display necessary data selected from the data stored in the working memory 83 on a display 85.

Cooling water 32*a* may be supplied either from a radiator or a cooling tower 50 provided with a pump P2 as shown in FIG. 6 and arranged on the roof of a building in order to cause the returned cooling water 32*b* to radiate heat and get back to effective cooling water 32*a* or from a pool of waste water in a residential quarter or factory premises provided with a pump P2.

If, for example, the cooling load is abruptly reduced in a cooling operation mode and the cooling operation of the absorber 1 by means of cooling water 32*a* is continued, the absorption of heat from the refrigerant in the absorber 1 and hence the evaporation of the refrigerant in the evaporator 26 can go on to excessively cool the cold/warm water 35*b* until it becomes frozen. In order to avoid such a situation, the temperature of the cold/warm water 35*b* at the outlet of the absorber 1 is detected so that the various working members are controlled in a manner as illustrated in FIG. 10. Note that the fan 51 of the cooling tower 50 is controlled for ON/OFF operations only when the cooling tower 50 is designed to make the cooling water 32*b* to radiate heat. The pump P2 interlock signal in FIG. 10 is a signal produced by the pump P2 to reflect the operating condition of the pump P2. In other word, the signal is produced (ON) when the pump P2 is in operation and not produced (OFF) when the pump P2 is out of operation.

In an absorption refrigerating machines-group apparatus 500 comprising a plurality of absorption refrigerating machines 100, or three absorption refrigerating machines 100A, 100B, 100C in the case of FIGS. 8 and 9, either pipe lines 31 for feeding the respective absorption refrigerating machines with cooling water 32*a* may be provided with respective pumps P2 (hereinafter called as "independent pump arrangement") as shown in FIG. 8 or a single pipe line 31 may be provided with a single common pump P2 (hereinafter called as "pump sharing arrangement") to feed the refrigerating machines 100A, 100B, 100C with cooling water 32*a* by way of a distributor or header 31A.

It is known that both the independent pump arrangement and the pump sharing arrangement may be controlled in a simple manner by means of a remotely disposed general control section for collectively controlling the operation of the three absorption refrigerating machines 100A, an adapter 300 disposed between the control section 200 and the absorption refrigerating machines 100A, 100B, 100C and a pump powering unit, or an independently installed power panel 400, disposed between the adapter 300 and the pump or pumps P2 for supplying power to the latter (hereinafter referred to as the first known technique).

More specifically, referring to the "independent pump arrangement" of FIG. 8, an operation/suspension signal for controlling the pumps P2 is issued from the control panel 200 to control relay 301 by way of signal line L1 by operating appropriate buttons on the control panel in order to switch the control relay 301, which by turn applies the operation/suspension command signal to the control sections 80 of the respective absorption refrigerating machines 100A, 100B, 100C.

Upon receiving an operation/suspension signal, the control sections 80 apply a signal for operating or suspending the operation of the respective pumps P2 to respective pump control relays 402, 403, 404 of the independently installed power panel 400 by way of respective signal lines L11, L12, L13, respective terminals on a terminal plate 302 and respective signal lines L11A, L12A, L13A to control the switching operation of the respective control relays 402, 403, 404.

Thus, the power source 405 for supplying power to the pumps P2 from a power line L21 is turned on or off by operating the respective pump control relays 402, 403, 404 in response to the operation/suspension command signals transmitted from the respective control sections 80 of the absorption refrigerating machines 100A, 100B, 100C.

Referring to the "pump sharing arrangement" of FIG. 9, all the signal lines L11, L12, L13 are connected to a single one of the terminals on the terminal plate 302 so that the power source 405 for supplying power to the pump P2 is turned on or off by operating only a single signal line L11A and a single pump control relay 402.

All the absorption refrigerating machines 100A, 100B, 100C may be arranged in a single large machine chamber such that a room to be air-conditioned may be supplied with cold/warm water 35*b* for air-conditioning and a desired number of refrigerating machines may be operated depending on the temperature of cold/warm water 35*b* that may vary depending on the temperature of the room. In other words, the pipe lines for cold/warm water 35*b* and those for cold/warm water 35*a* of the absorption refrigerating machines 100A, 100B, 100C are connected to a single pipe line that runs in the room to be air-conditioned.

Japanese Patent Application Laid-Open No. 4-254162 discloses a technique of storing the air-conditioning capacity of each of the absorption refrigerating machines 100A, 100B, 100C in a memory as a function of the temperature and the quantity of cold/warm water 35*b* so that a desired number of absorption refrigerating machines may be selected and operated for circulating cold/warm water 35*b* (hereinafter referred to as the second known technique).

Japanese Patent Applications Laid-Open Nos. 2-108399, 4-283341 and 4-288435 filed by the same applicant of the present invention disclose a technique of connecting each of the control sections 80 of the absorption refrigerating machines 100 and the control section of the indoor facility to which cold/warm water 35*b* is supplied for air-conditioning are connected by means of a telecommunications line so that signals may be exchanged between the control sections and an identification code or an address may be automatically assigned to each of the control sections at the very start of operation without giving rise to any telecommunications collisions (hereinafter referred to the third known technique).

There is also a know technique of controlling the telecommunications between the control sections by providing a telecommunications unit, using telecommunications ICs conforming to the RS485 Standards or the like. Note that the components denoted respectively by the same reference symbols in FIGS. 6 through 9 have identical functional features.

With the "pump sharing arrangement" of the first known technique, if one of the plurality of absorption refrigerating machines 100A, 100B, 100C, say the refrigerating machine 100A, has to stop supplying cooling water 32*a* for some reason or other, which may be a malfunctioning of the cooling tower 50 or a phenomenon of excessive cooling, a complex additional circuit have to be arranged for forcibly suspending the operation of the pump P2. If no such additional circuit is provided, the operation of the pump cannot be suspended and consequently the cold/warm water 35*b* may accidentally become frozen.

With the pump sharing arrangement, such an additional circuit is required in order to suspend the operation of the pump P2 because the phenomenon of excessive cooling is given rise to by the absorption refrigerating machines 100A, 100B, 100C. Otherwise, any of the absorption refrigerating machines may eventually malfunction so that the operator has to forcibly suspend the operation of the absorption refrigerating machines 100A, 100B, 100C by operating the control panel 200.

Additionally, of the large number of signal lines arranged between the adapter and the absorption refrigerating machines, the signal lines L11, L12, L13 according to the first known technique are costly two-core cables designed for relay control applications. Furthermore, independent signal lines have to be installed between the terminal plate 302 and the control sections so that a large number of wires are required for installing signal lines L11, L12, L13, an operation involving a large number of construction steps.

While the last problem may be solved by replacing the signal lines L11, L12, L13 with a single telecommunications line, employing a particular telecommunications arrangement for the control sections, the former two problems remains unsolved with such an arrangement.

Therefore, there is a demand for an absorption refrigerating machines-group apparatus that is free from the above problems.

SUMMARY OF THE INVENTION

According to a first aspect of the invention, the above problems are solved by providing an absorption refrigerating machines-group apparatus comprising a plurality of absorption refrigerating machines arranged at respective required positions, a remotely arranged control panel and an adapter disposed between said refrigerating machines and said control panel for relaying an operation control signal for controlling the operation of a cooling water circulation pump connected to each of said absorption refrigerating machines by piping, wherein it further comprises:

telecommunications line connecting means for connecting the control section of each of said absorption refrigerating machines and the control section of said adapter by way of a telecommunications line; and control relay means for transmitting a temporary control signal to each of the currently operating absorption refrigerating machines by way of said telecommunications line each time it relays an operation control signal in order to bring each of said absorption refrigerating machines into a temporary state of requiring said pump to suspend its operation or being capable of suspending the operation of said pump by means of said temporary control signal and controlling said operation of said circulation pump by means of a signal obtained by said temporary state.

According to a second aspect of the invention, there is provided an absorption refrigerating machines-group apparatus comprising a plurality of absorption refrigerating machines arranged at respective required positions, a remotely arranged control panel and an adapter disposed between said refrigerating machines and said control panel for relaying an operation control signal for controlling the operation of either a pump or a cooling tower disposed along the route of circulation of cooling water for cooling a necessary area of each of said absorption refrigerating machines or pump/cooling tower, wherein it further comprises:

telecommunications line connecting means for connecting the control section of each of said absorption refrigerating machines and the control section of said adapter by way of a telecommunications line; and control relay means for transmitting a temporary control signal to each of the currently operating absorption refrigerating machines by way of said telecommunications line each time it relays an operation control signal in order to bring each of said absorption refrigerating machines into a temporary state of requiring said pump/cooling tower to suspend its operation or being capable of suspending the operation of said pump/cooling tower by means of said temporary control signal and controlling said operation of said circulation pump by means of a signal obtained by said temporary state.

According to a third aspect of the invention, there is provided an absorption refrigerating machines-group apparatus comprising a plurality of absorption refrigerating machines arranged at respective required positions, a remotely arranged control panel and an adapter disposed between said refrigerating machines and said control panel for relaying an operation control signal for controlling the operation of a plurality of pumps of feeding cooling water for cooling respective necessary areas of said absorption refrigerating machines, wherein it further comprises:

number of pumps selection means for selecting either the shared use of one of said pumps for said plurality of absorption refrigerating machines or the exclusive use of any of said pumps belonging to said respective absorption refrigerating machines, said adapter being provided with an operating section for obtaining a signal responsible for said shared use, or a sharing signal;

all refrigerating machines suspension commanding means for, when any of said absorption refrigerating machines transmits a signal requiring the suspension of said pump and a sharing signal is being obtained, transmitting a command signal to all the other currently operating absorption refrigerating machines from said adapter in order to bring each of said absorption refrigerating machines into a temporary state of requiring said pump to suspend its operation or being capable of suspending the operation of said pump;

temporary state achieving means for achieving said temporary state for all the currently operating absorption refrigerating machines by said command signal and sending out a signal, or a pump suspension signal, obtained in said temporary state; and pump suspending means for controlling the suspension of the operation of said pumps after receiving a pump suspension signal from each and every one of said absorption refrigerating machines.

According to a fourth aspect of the invention, there is provided an absorption refrigerating machines-group apparatus comprising a plurality of absorption refrigerating machines arranged at respective required positions, a remotely arranged control panel and an adapter disposed between said refrigerating machines and said control panel for relaying an operation control signal for controlling the operation of a pump shared by said absorption refrigerating machines of feeding cooling water for cooling respective necessary areas of said absorption refrigerating machines, wherein it further comprises:

all refrigerating machines suspension commanding means for, when any of said absorption refrigerating machines transmits a signal requiring the suspension of said pump and a sharing signal is being obtained, transmitting a command signal to all the other currently operating absorption refrigerating machines from said adapter in order to bring each of said absorption refrigerating machines into a temporary state of requiring said pump to suspend its operation or being capable of suspending the operation of said pump;

temporary state achieving means for achieving said temporary state for all the currently operating absorption refrigerating machines by said command signal and sending out a signal, or a pump suspension signal, obtained in said temporary state; and pump suspending means for controlling the suspension of the operation of said pumps after receiving a pump suspension signal from each and every one of said absorption refrigerating machines.

With an absorption refrigerating machines-group apparatus according to the first or second aspect of the invention, since the control sections of the absorption refrigerating machines and the control section of the adapter are connected with a single telecommunications line and no duplicate wires are arranged, the volume of wire and the construction steps required for installing the telecommunications line can be significantly reduced to consequently reduce the cost of the apparatus. Additionally since either the pump or the cooling tower for supplying cooling water or both of them are controlled for operation according to the temporary state of each of the absorption refrigerating machines and by means of the telecommunications line, any abnormal condition due to an accidental suspension of the operation of the shared pump or the cooling tower can be effectively prevented from taking place.

With an absorption refrigerating machines-group apparatus according to the third aspect of the invention, since a sharing signal is obtained for supplying cooling water by means of a shared pump, an adapter can be commonly used for both the "pump sharing arrangement" and the "individual pump arrangement". Additionally, when a sharing signal is obtained, the operation of the pump can be suspended from all the operating absorption refrigerating machines in a temporary state or after a response signal saying that the supply of cooling water is controlled and can be suspended at any time is obtained so that any abnormal condition due to an accidental suspension of the operation of the pump can be effectively prevented from taking place.

Finally, with an absorption refrigerating machines-group apparatus according to the invention, since the operation of the pump can be suspended from all the operating absorption refrigerating machines in a temporary state or after a response signal saying that the supply of cooling water is controlled and can be suspended at any time is obtained, again, any abnormal condition due to an accidental suspension of the operation of the pump can be effectively prevented from taking place.

BRIEF DESCRIPTION OF THE DRAWINGS

In the drawings, FIGS. 1 through 5 illustrate a preferred embodiment of the invention and FIGS. 6 through 10 illustrate a comparable known apparatus.

FIG. 1 is a block diagram of the entire apparatus.

FIG. 2 is a block diagram of the entire apparatus.

FIG. 3 is a block diagram of principal components of the apparatus.

FIG. 4 is a flow chart of principal components of the apparatus.

FIG. 6 is a detailed block diagram of principal components of the apparatus.

FIG. 7 is a block diagram of principal components of the apparatus.

FIG. 8 is a block diagram of the entire apparatus.

FIG. 9 is a block diagram of the entire apparatus.

FIG. 10 is a timing chart of the operation of principal components of the apparatus.

DETAILED DESCRIPTION OF THE PREFERRED EMBODIMENTS

Now, a preferred embodiment of the invention will be described by referring to FIGS. 1 through 5B of the accompanying drawings. Note that, throughout the drawings, those components that are denoted by reference symbols that are same as those in FIGS. 6 through 10 are functionally identical with their counterparts in FIGS. 6 through 10 so that the components indicated by a same reference symbol will be described only once.

Figure 1:
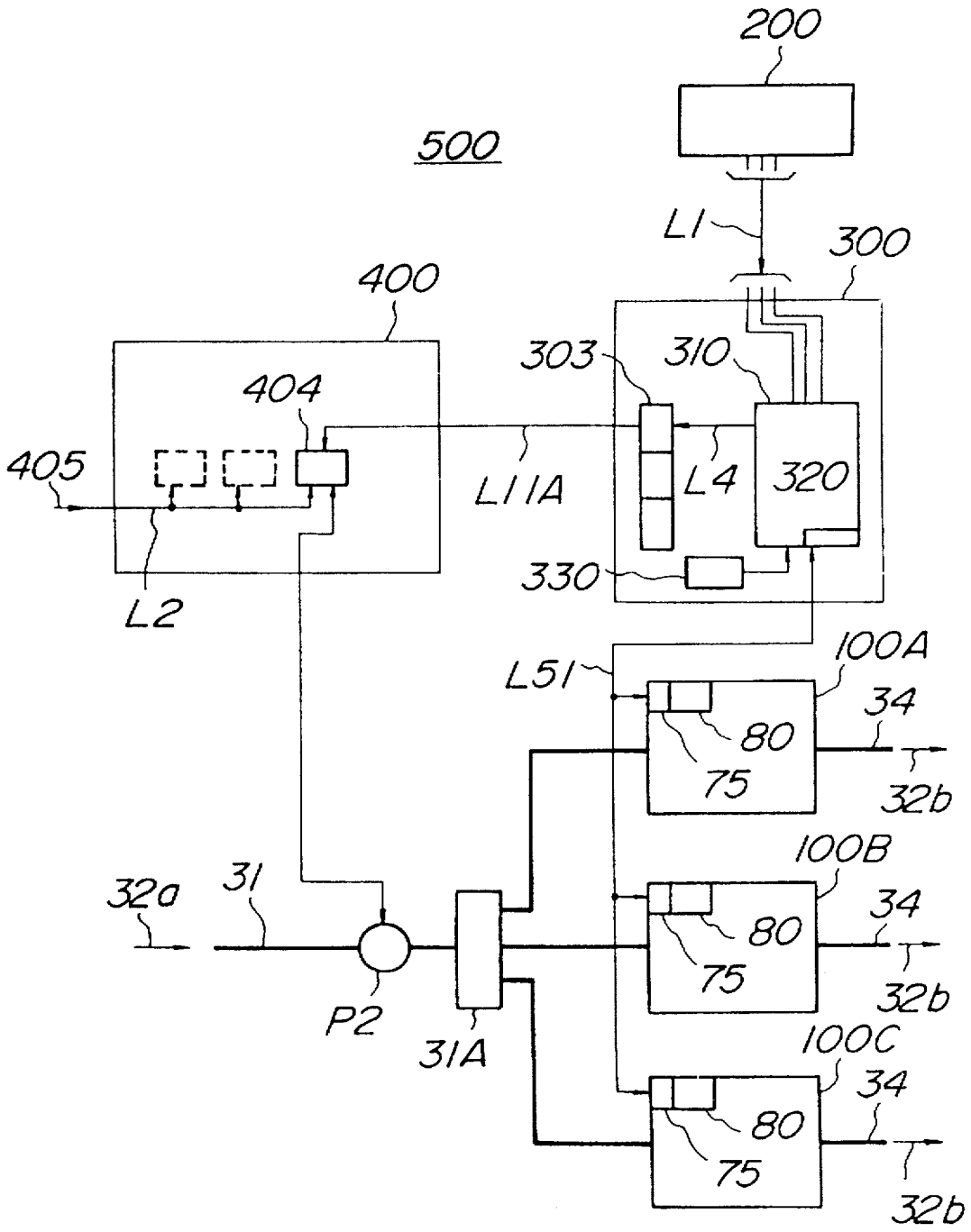
Figure 2:
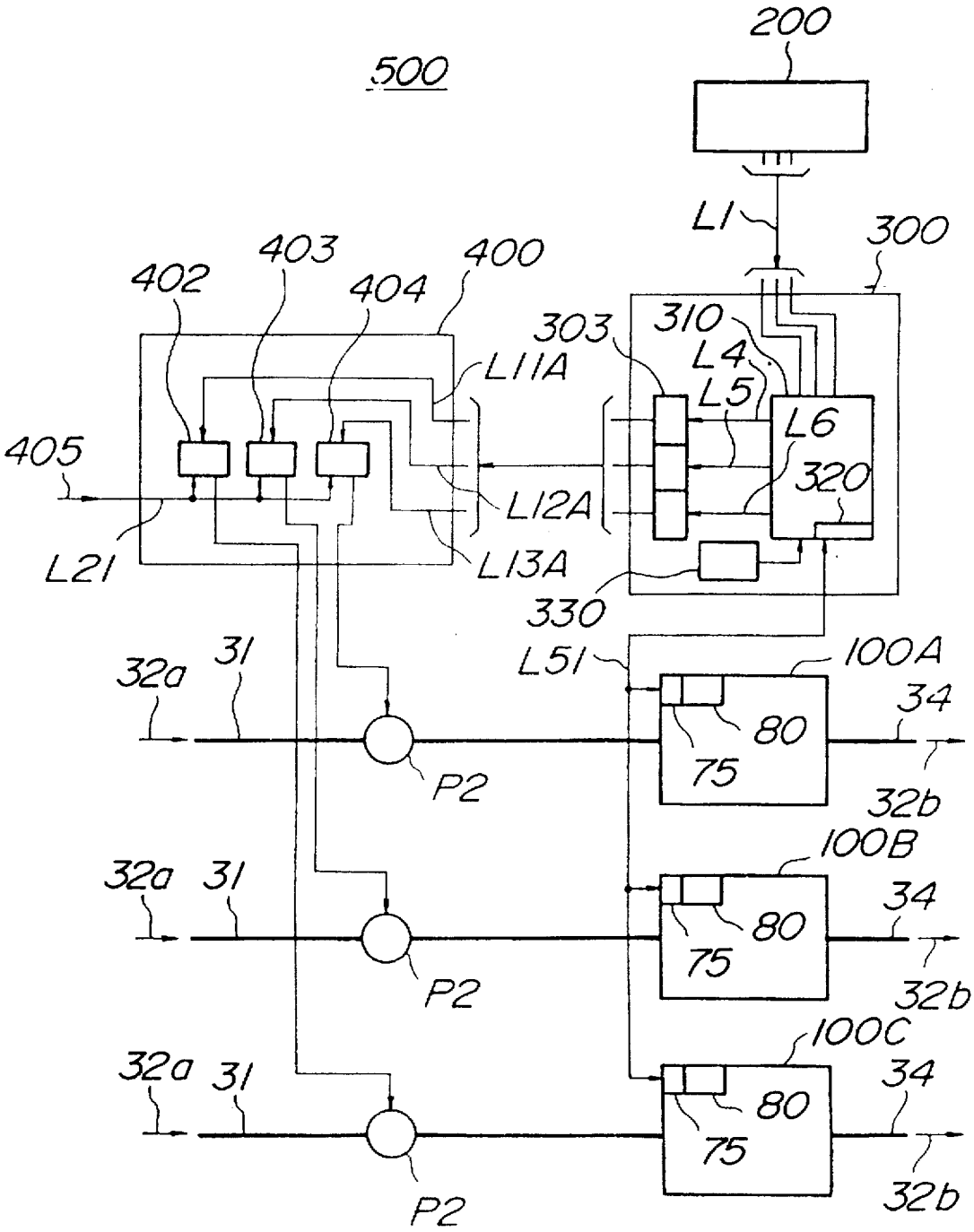

In the arrangement of FIG. 1, the control section 310 of the adapter 300 is connected to the control sections 80 of the absorption refrigerating machines 100A, 100B, 100C by way of a telecommunications line L51, which may be a shielded two-core cable or a twisted and paired cable, in order to relay a signal for controlling the operation of the pump P2 for feeding cooling water 32*a* by way of a control section 310 and select the number of pumps P2 to be operated by means of a value-setting section 330 arranged in the adapter 300 so that the adapter 300 may be commonly used for both the "pump sharing arrangement" of FIG. 1 and the "individual pump arrangement" of FIG. 2.

Figure 3:
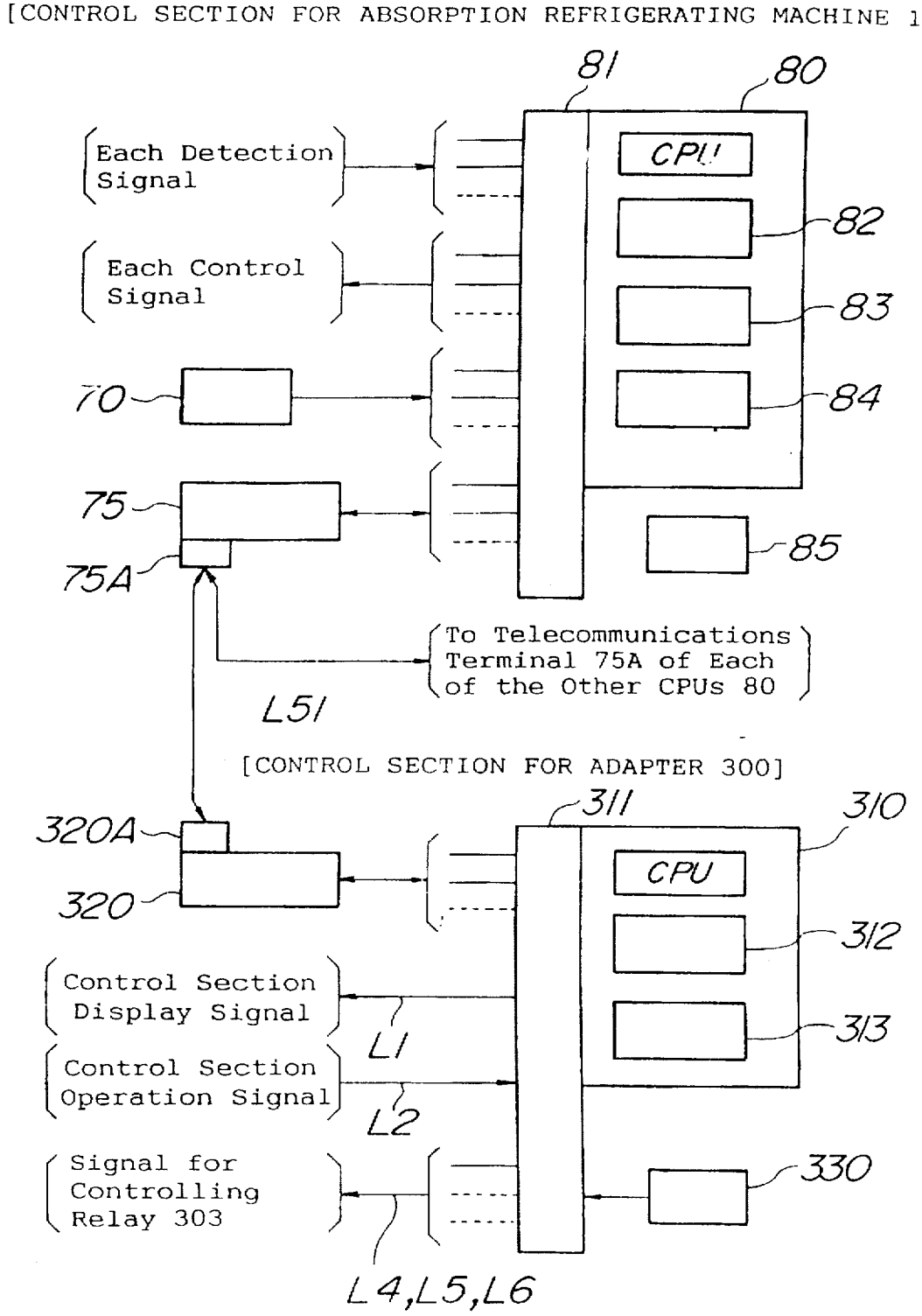

Referring to FIGS. 1 and 2, the control section 310 of the adapter 300 and each of the control sections 80 of the absorption refrigerating machines 100A, 100B, 100C exchange control signals having an identification code of the addressee by means of the respective telecommunications units 320 and 75 and by way of the telecommunications line L51 in order to carry out necessary control operations. FIG. 3 shows a block diagram of this telecommunications system. The control signal produced by the control section 310 selectively controls a group of control relays 303 and the corresponding one or ones of the pump control relays 402, 403, 404 by way of the signal lines L4, L5, L6 to by turn control the operation/suspension of the corresponding one or ones of the pumps P2.

The group of control relays 303 are controlled for the respective open/closed states by a short switching signal provided typically by a transistor relay circuit capable of operating as a flip-flop. The power source 405 feeds the control relays 402, 403, 404 with power.

Referring to FIG. 3, the control sections 310 and 80 have a similar configuration and designed to receive necessary signals from the respective input/output ports 311 and 81 and stores them in the respective working memories 313 and 83. The control sections 310 and 80 also carry out arithmetic processing operations, using programs stored in the respective processing memories 312 and 82, the number of pumps and that of absorption refrigerating machines to be operated as well as other data to produce and transmit control signals and display signals to the related units by way of the input/output ports 311 and 81.

The value-setting section 330 receives numerical values concerning the number of pumps P2 and that of absorption refrigerating machines 100A, 100B, 100C to be operated and so on necessary for processing operations and stores them in the respective working memories 313.

The telecommunications units 75 and 320 typically comprises telecommunications ICs conforming to the RS485 Standards or the like and are designed to control the exchange of signals between the control sections 310 and 80 by way of shielded two-core cables. The processing memory 312 of the control section 310 and the processing memories 83 of the control sections 80 stores programs for the flow of processing operation necessary for the signal exchange.

Figure 4:
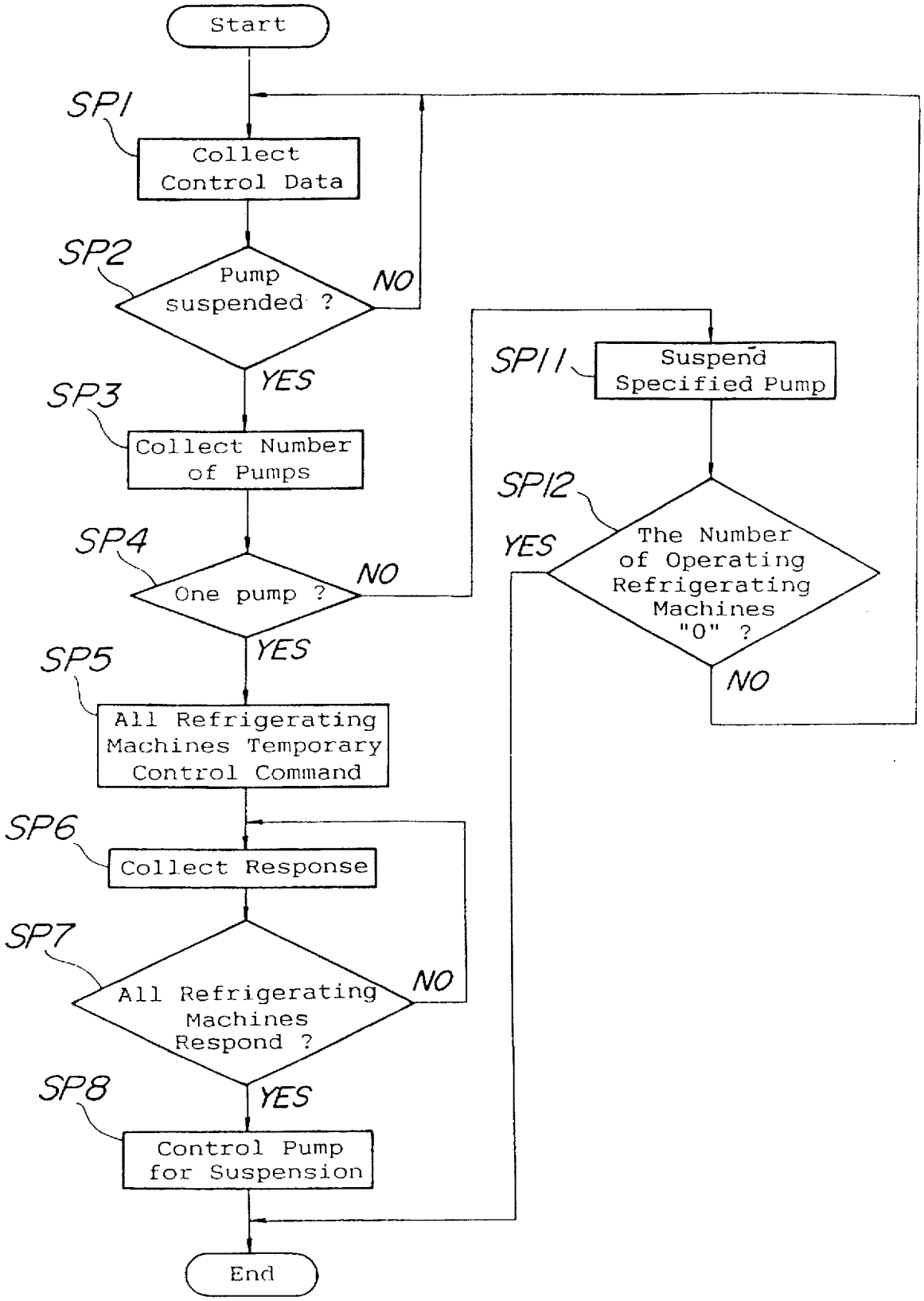

Now, the flow chart of processing operation illustrated in FIG. 4 will be described. The flow chart of FIG. 4 is applicable to the case where the adapter 300 is commonly used for both the "pump sharing arrangement" and the "individual pump arrangement" and adapted to control the pumps P2 according to the signals supplied by the control panel 200 and the control sections 80. Note, however, the flow chart illustrates only the suspension of any of the pumps P2 and the operation of the pumps P2 is omitted.

[Flow of Processing Operation]

In Step SP1, control data stored in the working memory 313 including an operation signal supplied by the control panel 200 by way of the signal line L2 and a control signal supplied from each of the control sections 80 by way of the telecommunications line L51 in order to control the operation of the pumps P2 are collected to move to the next step or Step SP2.

In Step SP2, it is determined if the collected control data is a data for suspending the operation of any of the pumps P2, or it is a "data requesting the suspension of any of the pumps P2", or not. If it is a "data requesting the suspension of any of the pumps P2", the processing operation proceeds to Step SP3. If not, it returns to Step SP1.

If the collected data is determined to be a "data requesting the suspension of any of the pumps P2", it means that a control signal for suspending any of the pumps P2 is given by the control panel 200 or a control signal requesting the suspension of the related pump P2 is issued by any of the absorption refrigerating machines 100A, 100B, 100C.

Each of the absorption refrigerating machines 100A, 100B, 100C issues a control signal requesting the suspension of the related pump P2 when the temperature of the cold/warm water 35*b* or the reading of the temperature sensor S2 is too low, indicating that there exists over-cooling, when the absorption refrigerating machine is operating abnormally and an abnormality detection signal is sent to the control section 80, when an abnormality suspension signal is applied to the value-setting section 75 for some emergency reason or for servicing or when the cooling operation mode is switched to the heating operation mode or vice versa by a detection signal of the room temperature sensor or an input signal from the value-setting section.

In Step SP3, the data on the number of pumps P2 stored in the working memory 313 is collected to move to the next step, or Step SP4.

In Step SP4, if the data on the number of pumps is "one" or not is determined. If it is one, the processing operation proceeds to Step SP5. If not, the operation jumps to Step SP11.

The number of pumps is determined on the basis of the data signal obtained from the data concerning the number of pumps stored in advance in the working memory 313. When the processing operation moves to Step SP5, it signifies that the "pump sharing arrangement" of FIG. 1 is at work. When, on the other hand, the operation jumps to Step SP11, it indicates that the "individual pump arrangement" of FIG. 2 is being used.

In Step SP5, a command signal for controlling all the other currently operating absorption refrigerating machines 100A, 100B, 100C to make them ready to suspend the operation of the pump P2, or "all refrigerating machines suspension commanding signal" is issued to the refrigerating machines. Then, the processing operation moves to Step SP6.

The "all refrigerating machines suspension commanding signal" gives rise to a temporary state that requires the suspension of the pump P2 such as, for example, the state where the cold/warm water 35*b* is temporarily excessively cooled or the state where the pump P2 is practically suspended in order to prevent it from being frozen due to over-cooling or where the pump 3 is suspended, the operation of heating the high-temperature regenerator 5 by the heater 6 is suspended or the control valve V2 is opened so that the operation of the pump P2 can be suspended any time. At the same time, a signal telling that the temporary state is brought in (hereinafter referred to as a "signal obtained by a temporary state" for the purpose of the invention), or a "pump suspension signal" is sent to the control section 310 as a response.

When a "pump suspension signal" is transmitted as a response, the pump P2 is controlled to make it ready for suspension. In other word, the pump 2 is put into a state in a controlled manner where the pump P2 is practically suspended in order to prevent it from being frozen due to over-cooling or where the pump 3 is suspended, the operation of heating the high-temperature regenerator 5 by the heater 6 is suspended or the control valve V2 is opened.

A temporary state requiring the suspension of the pump P2 may be the state where the operation of the pump P2 can be suspended. In short, a temporary state is a state where the absorption refrigerating machines remains free from abnormality and malfunction if the operation of the pump P2 is suspended.

Alternatively, a "all refrigerating machines suspension commanding signal" may be sent to the control sections 80 of all the absorption refrigerating machines. However, the objective of the signal is achieved when it is received by the control sections 80 of the currently operating absorption refrigerating machines other than the absorption refrigerating machine that transmitted a signal requesting the suspension of the pump P2.

It should be noted that the data on the currently operating absorption refrigerating machines can be obtained without difficulty because, when any of the absorption refrigerating machines 100A, 100B, 100C started or terminated the operation, a data representing the start or the termination is sent to the control section 310 and stored in the working memory 313 with the address or the identification code of the control section 80 that transmitted the data. This description equally applies to Steps SP7 and 12, which will be described hereinafter.

In Step SP6, a response signal that is a "pump suspension signal" is collected and the processing operation proceeds to Step SP7.

In Step SP7, it is determined if a "pump suspension signal" is collected from each and every one of the currently operating absorption refrigerating machines. If it is determined that a "pump suspension signal" is collected from each and every one of the currently operating absorption refrigerating machines, the processing operation moves to Step SP8. If not, the operation returns to Step SP6.

In Step SP8, a control signal for switching the control relay 303 corresponding to the signal line L4 to make it open is issued by the control section 310 so that the pump control relay 404 is switched to become open and the operation of the pump P2 is suspended. At the same time, a display signal for displaying that the pump P2 is suspended is applied to the control panel 200 by way of the signal line L1 to terminate the control operation.

In Step SP11, the operation of the pump P2 having the address, or the identification code, of the control section 80 that transmitted a "pump suspension request data" is suspended and the processing operation proceeds to Step SP12.

With regard to the suspension of the operation of the pump P2, if the control section 80 that transmitted "a pump suspension request data" is that of the absorption refrigerating machine 100B, the pump control relay 403 is switched to become open by a signal transmitted from the control section 310 by way of the signal line L5 in order to open the pump control relay 403 and suspend the operation of the related pump P2. If the signal line L1 is so designed as to provide a signal for displaying the states of a plurality of pumps, a display signal indicating that the pump P2 is suspended is transmitted to the control panel 200 by way of the signal line L1.

In Step SP12, it is determined if there is any pump P2 still operating or not. If it is determined that there is no pump P2 still operating or the number of pumps P2 currently operating is 0, the processing operation is terminated. Otherwise, the processing operation goes back to Step SP1.

[Modified Flow of Processing Operation]

If only a single pump P2 is used for the "pump sharing arrangement", a flow chart obtained by removing Steps SP3 and SP4 and Steps SP11 and SP12 from the flow chart of FIG. 3.

[Modified Pump Arrangement]

While the pumps P2 are controlled for operation/suspension in the above embodiment, it may be understood that the cooling towers 50 may alternatively be controlled to achieve the same objective by controlling the components necessary for the operation/suspension of the pumps P2, the cooling tower fans 51 and so on.

If the pumps P2 and the cooling towers 50 are independently installed, both the pump P2 and the cooling towers 50 may be controlled for the purpose of the invention.

[Summary of the Embodiment]

Now, the arrangements of FIGS. 1 through 3 will be summarized.

According to a first aspect of the invention, there is provided an absorption refrigerating machines-group apparatus 500 comprising a plurality of absorption refrigerating machines 100A, 100B, 100C arranged at respective required positions, a remotely arranged control panel 200 and an adapter 300 disposed between said refrigerating machines 100A, 100B, 100C and said control panel for relaying an operation control signal for controlling the operation of a cooling water circulation pump P2 connected to each of said absorption refrigerating machines by piping, wherein it further comprises:

telecommunications line connecting means for connecting the control section 310 of each of said absorption refrigerating machines 100A, 100B, 100C and the control section 310 of said adapter 300 by way of a telecommunications line; and control relay means for transmitting a temporary control signal to each of the currently operating absorption refrigerating machines by way of said telecommunications line L51 each time it relays an operation control signal in order to bring each of said absorption refrigerating machines into a temporary state of requiring said pump to suspend its operation or being capable of suspending the operation of said pump by means of said temporary control signal and controlling said operation of said circulation pump by means of said temporary control signal typically according to the flow chart illustrated in FIG. 3.

According to a second aspect of the invention, there is provided an absorption refrigerating machines-group apparatus 500 adapted to the above [Modified Pump Arrangement] for controlling the pump P2 and the cooling tower 50 and comprising a plurality of absorption refrigerating machines 100A, 100B, 100C arranged at respective required positions, a remotely arranged control panel 200 and an adapter 300 disposed between said absorption refrigerating machines 100A, 100B, 100C and said control panel 200 for relaying an operation control signal for controlling the operation of either a pump P2 or a cooling tower 50 disposed along the route of circulation of cooling water for cooling a necessary area of each of said absorption refrigerating machines, wherein it further comprises:

telecommunications line connecting means for connecting the control section 80 of each of said absorption refrigerating machines 100A, 100B, 100C and the control section 310 of said adapter 300 by way of a telecommunications line L51; and control relay means for transmitting a temporary control signal to each of the currently operating absorption refrigerating machines by way of said telecommunications line L51 each time it relays an operation control signal in order to bring each of said absorption refrigerating machines into a temporary state of requiring said pump P2 to suspend its operation or being capable of suspending the operation of said pump P2 of said cooling tower 50 by means of said temporary control .signal and controlling said operation of said circulation pump by means of said temporary control signal according to the flow chart of FIG. 4.

According to a third aspect of the invention, there is provided an absorption refrigerating machines-group apparatus 500 adapted to accommodate both the arrangement of FIG. 1 and that of FIG. 2 by means of an adaptor 300 specifically designed for it and comprising a plurality of absorption refrigerating machines 100A, 100B, 100C arranged at respective required positions, a remotely arranged control panel 200 and an adapter disposed between said absorption refrigerating machines 100A, 100B, 100C and said control panel 200 for relaying an operation control signal for controlling the operation of a plurality of pumps P2 arranged the circulation path of cooling water 32*a* for cooling respective necessary areas of said absorption refrigerating machines, wherein it further comprises:

number of pumps selection means for selecting either the shared use of one of said pumps P2 for said plurality of absorption refrigerating machines 100A, 100B, 100C, or "pump sharing arrangement", or the exclusive use of any of said pumps P2 belonging to said respective absorption refrigerating machines 100A, 100B, 100C, or "individual pump arrangement", said adapter being provided with an operating section for obtaining a signal responsible for said shared use, or a sharing signal representing "one" pump P2 is stored in advance in a working memory 313, a value-setting section 330 being provided in said adaptor 300;

all refrigerating machines suspension commanding means for, when any of said absorption refrigerating machines 100A, 100B, 100C transmits a signal requiring the suspension of said pump as a result of that, for example, a "suspension request data" is transmitted from the control section 80, and a sharing signal is being obtained, that is a sharing signal representing "one" pump P2 is obtained, transmitting a command signal from the adapter 300 to all the other currently operating absorption refrigerating machines from said adapter in order to bring each of said absorption refrigerating machines into a temporary state of requiring said pump P2 to suspend its operation or being capable of suspending the operation of said pump P2;

temporary state achieving means for achieving said temporary state for all the currently operating absorption refrigerating machines by said command signal in order to prevent an over-cooling of the cold/warm water 35*b* in advance and sending out a signal, or a "pump suspension signal", obtained in said temporary state; and pump suspending means for controlling the suspension of the operation of said pumps P2 by opening, for example, the control relay 303 by means of the adapter 300, or the control section 310 of the adapter 300, and the signal line L4 and consequently opening the pump control relay 404 after receiving a "pump suspension signal" from each and every one of said absorption refrigerating machines.

According to a fourth aspect of the invention, there is provided an absorption refrigerating machines-group apparatus 500 adapted to the arrangement of FIG. 1 and the above [Modified Flow of Processing Operation] and comprising a plurality of absorption refrigerating machines 100A, 100B, 100C arranged at respective required positions, a remotely arranged control panel 200 and an adapter 300 disposed between said absorption refrigerating machines 100A, 100B, 100C and said control panel 200 for relaying an operation control signal for controlling the operation of a shared pump P2 of feeding cooling water 32*a* for cooling respective necessary areas of said absorption refrigerating machines, wherein it further comprises:

all refrigerating machines suspension commanding means, temporary state achieving means and pump suspending means as in the case of the apparatus according to the third aspect of the invention.

[Modifications to the Embodiment]

The following modifications to the above embodiment are also found within the scope of the invention.

Figure 5A:
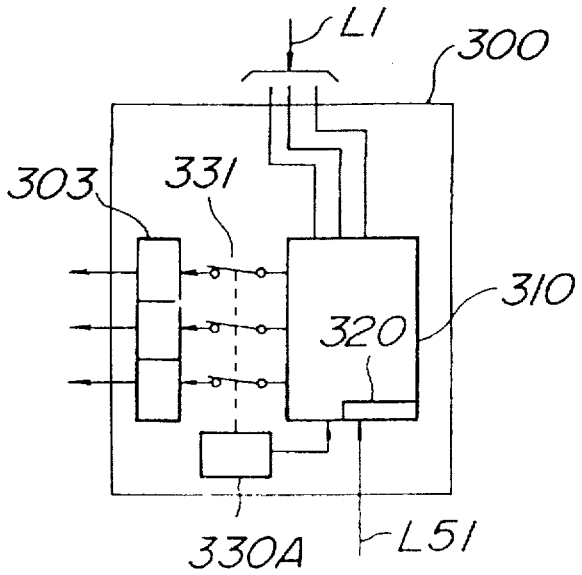
FIG. 5A and 5B are block diagrams of principal components of the apparatus.
Figure 5B:
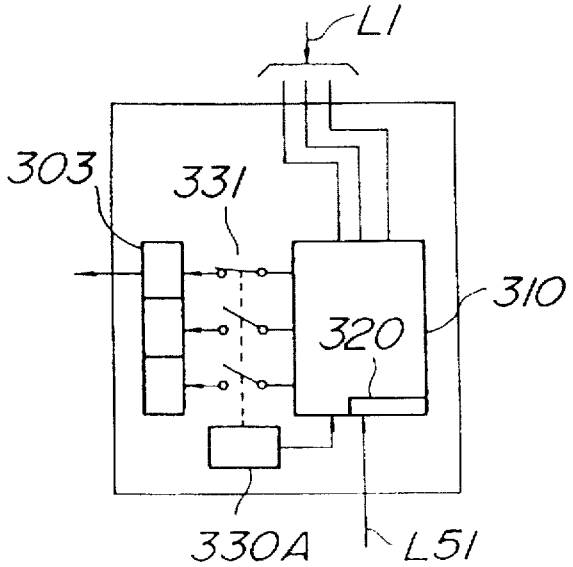
Figure 6:
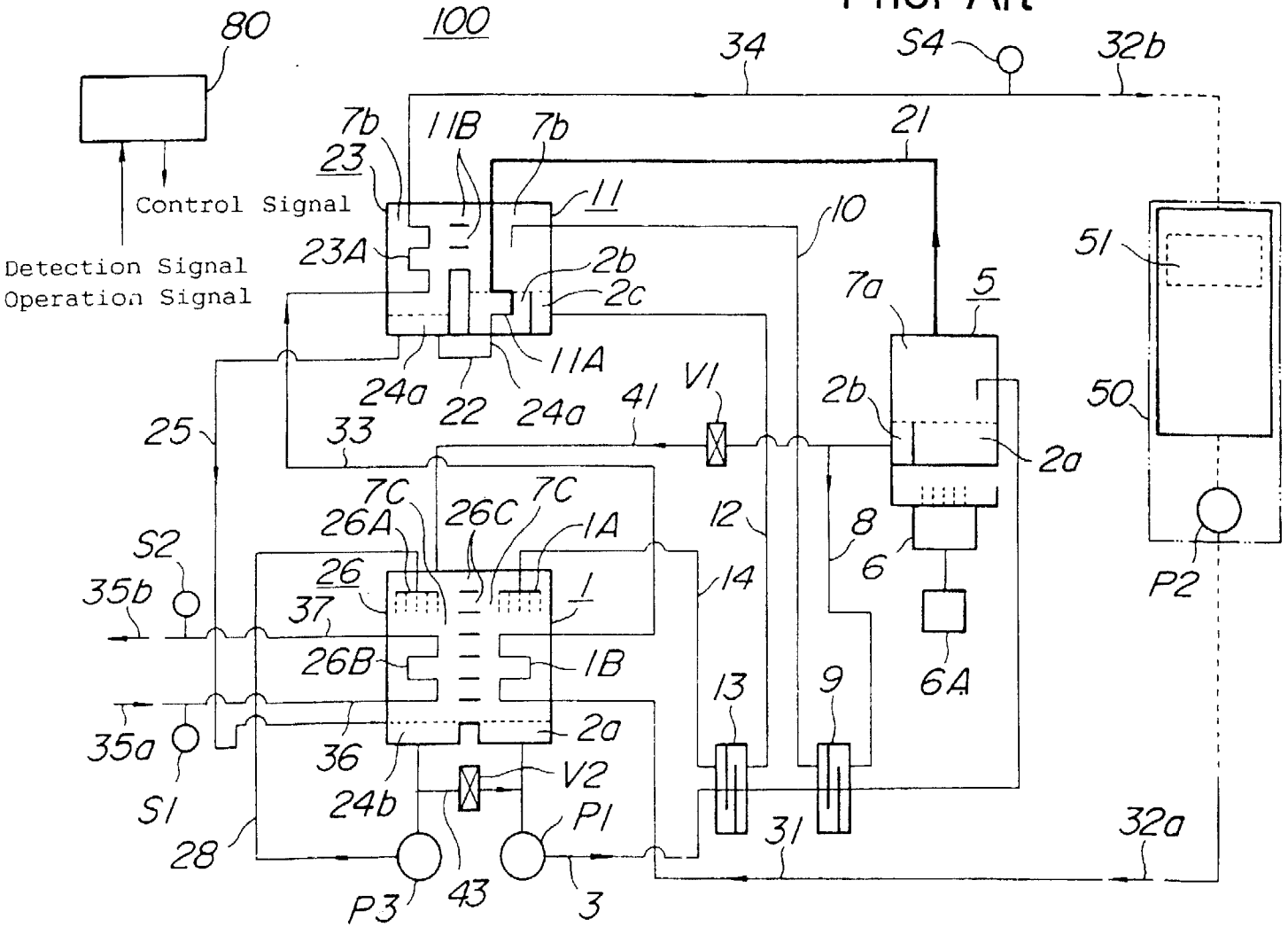
FIG.6 Prior Art
Figure 7:
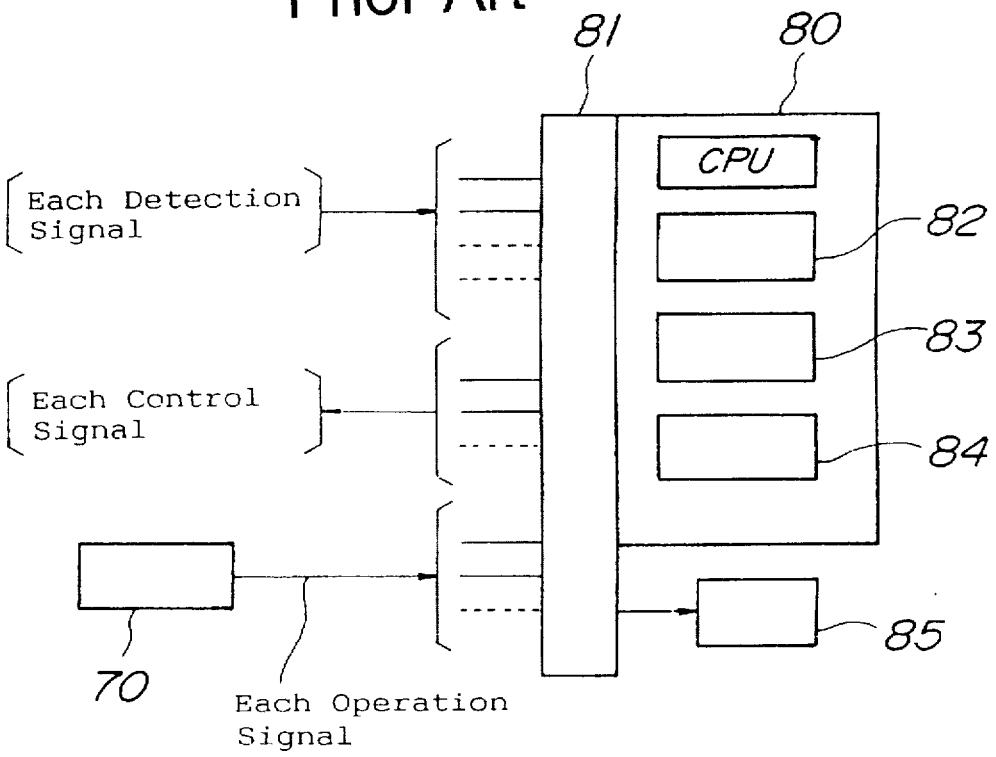
FIG.7 Prior Art
Figure 8:
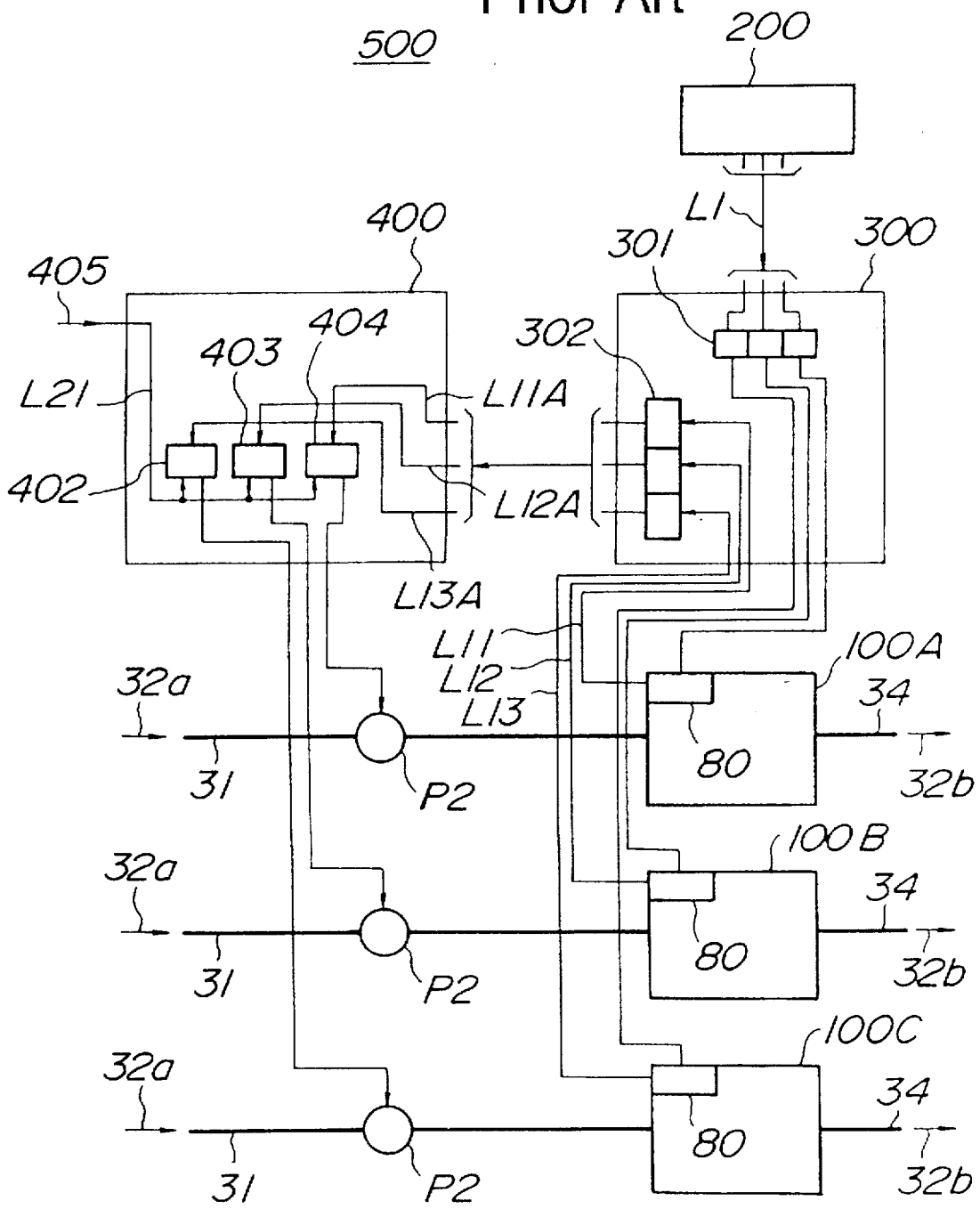
FIG.8 Prior Art
Figure 9:
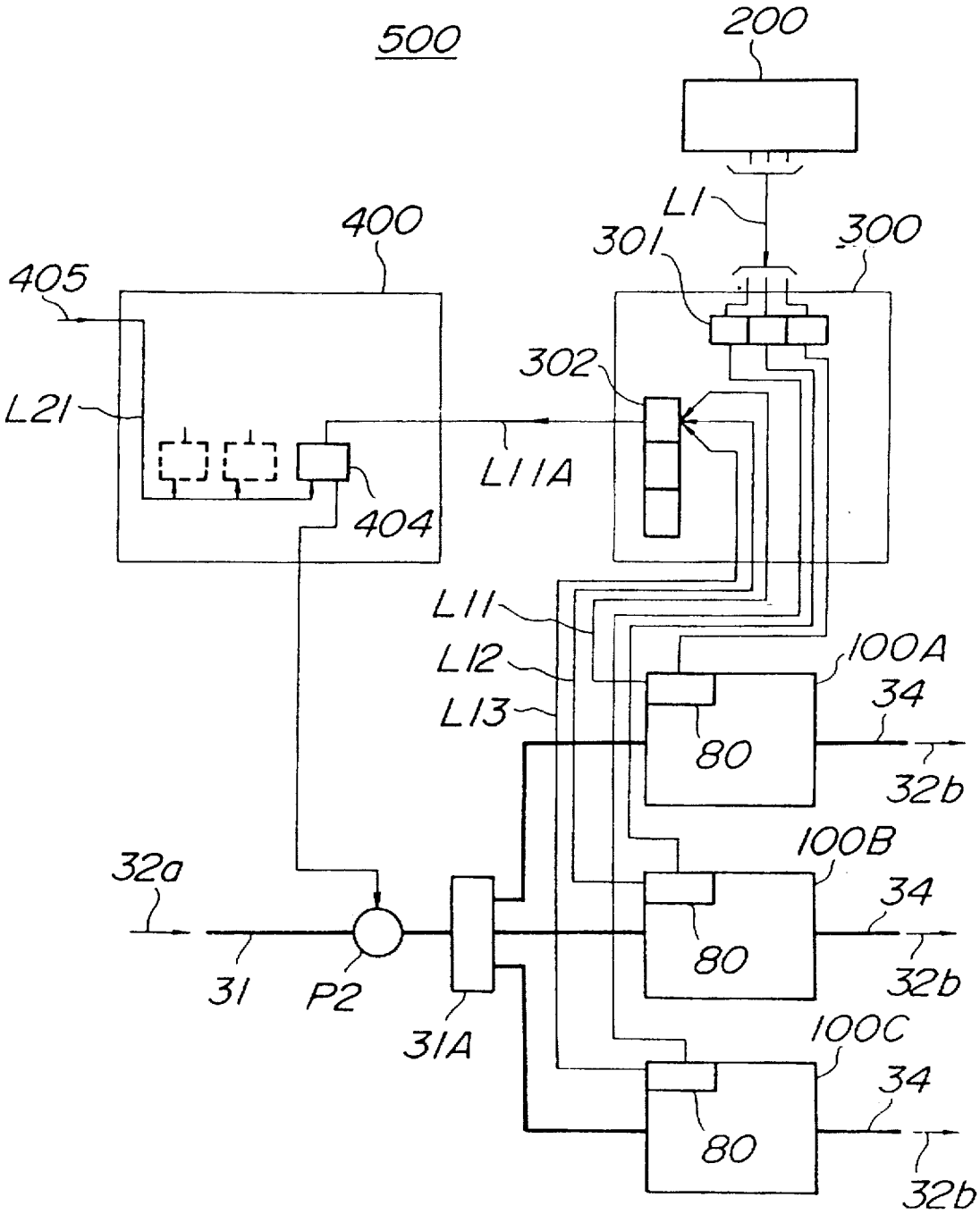
FIG.9 Prior Art
Figure 10:
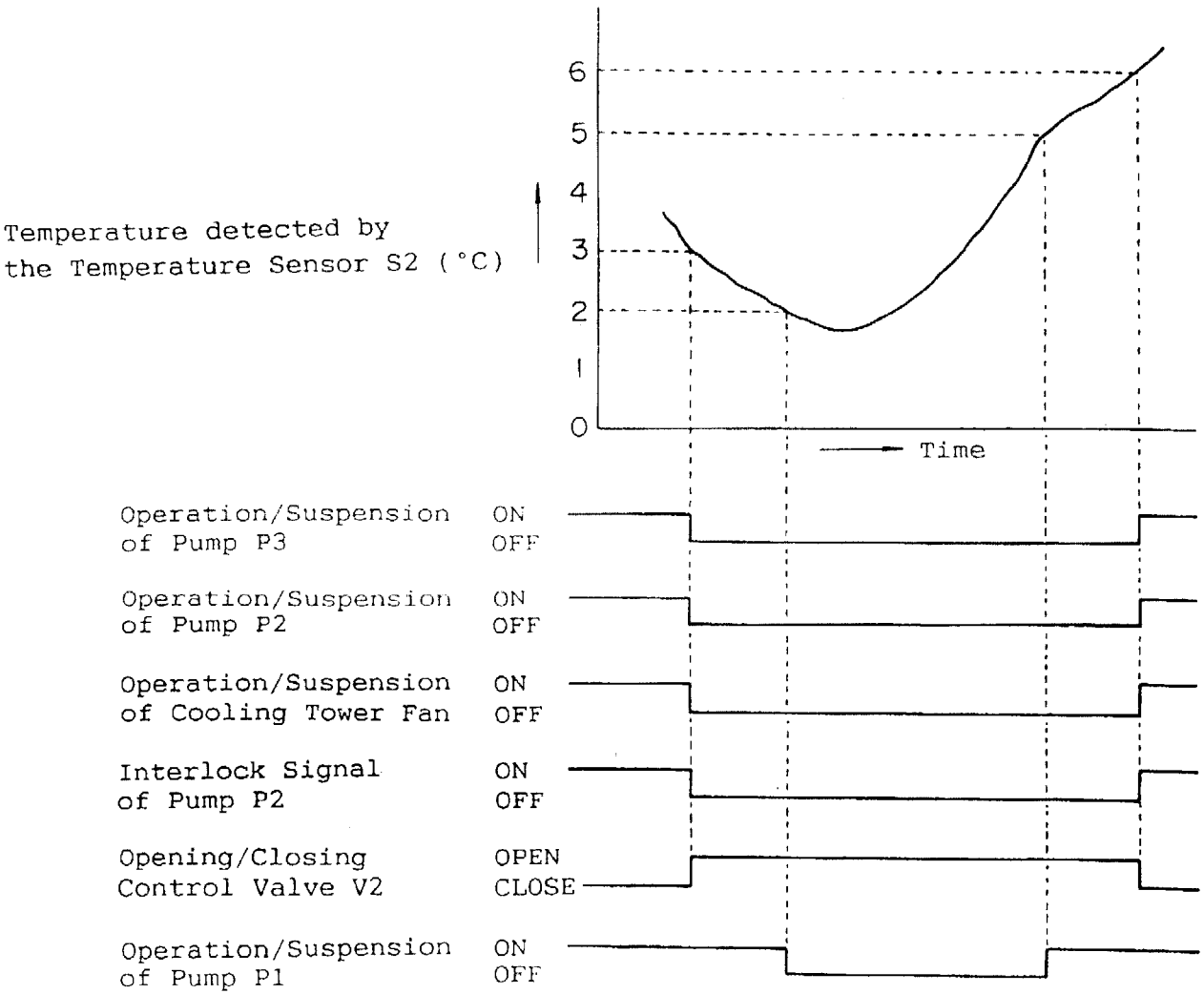
FIG.10 Prior Art

(1) The value-setting section 330 of the adapter 300 may be so modified as illustrated in FIGS. 5A and 5B. More specifically, there is provided a selection switch 331 to selectively switching the operation of the signal lines L4, L5, L7 for transmitting control signals from the control section 310 to the control relay group 303. Additionally, there is also provided a value-setting section 330A including a digital switch for obtaining a modified digital signal in response to a switching operation of the selection switch 331 in an interlocked manner. With the above arrangement, the operation of connecting a control line to the pump P2 and entering a data on the number of pumps can be carried out in a single action to switch from the "pump sharing arrangement" to the "individual pump arrangement" or vice versa.

(2) Steps necessary for operating the pump P2 are added to the flow chart of FIG. 4.

(3) The absorption refrigerating machines 100A, 100B, 100C are partly or wholly replaced by absorption refrigerating machines designed for cooling or those designed for heating.

(4) The control panel 200 is provided with a control section similar to the any of the control sections 80 and a telecommunications unit to link the telecommunications unit with the telecommunications unit of the control section 310 by way of a telecommunications line L51 so that the operation of the apparatus can be controlled by telecommunications signals.

According to the first and second aspects of the invention, since the control sections of the absorption refrigerating machines and the control section of the adapter are connected with a single telecommunications line and no duplicate wires are arranged, the volume of wire and the construction steps required for installing the telecommunications line can be significantly reduced to consequently reduce the cost of the apparatus. Additionally since either the pump or the cooling tower for supplying cooling water or both of them are controlled for operation according to the temporary state of each of the absorption refrigerating machines and by means of the telecommunications line, any abnormal condition due to an accidental suspension of the operation of the shared pump or the cooling tower can be effectively prevented from taking place.

With an absorption refrigerating machines-group apparatus according to the third aspect of the invention, since a sharing signal is obtained for supplying cooling water by means of a shared pump, an adapter can be commonly used for both the "pump sharing arrangement" and the "individual pump arrangement". Additionally, when a sharing signal is obtained for the "pump sharing arrangement", the operation of the pump can be suspended from all the operating absorption refrigerating machines in a temporary state or after a response signal saying that the supply of cooling water is controlled and can be suspended at any time is obtained so that any abnormal condition due to an accidental suspension of the operation of the pump can be effectively prevented from taking place.

Finally, with an absorption refrigerating machines-group apparatus according to the invention, since the operation of the pump can be suspended from all the operating absorption refrigerating machines in a temporary state or after a response signal saying that the supply of cooling water is controlled and can be suspended at any time is obtained for the "pump sharing arrangement", again, any abnormal condition due to an accidental suspension of the operation of the pump can be effectively prevented from taking place.

What is claimed is:

1. An absorption refrigerating machines-group apparatus comprising a plurality of absorption refrigerating machines arranged at respective required positions, a remotely arranged control panel and an adapter disposed between said refrigerating machines and said control panel for relaying an operation control signal for controlling the operation of a plurality of pumps of feeding cooling water for cooling respective necessary areas of said absorption refrigerating machines, characterized in that it further comprises:

number of pumps selection means for selecting either the shared use of one of said pumps for said plurality of absorption refrigerating machines or the exclusive use of any of said pumps belonging to said respective absorption refrigerating machines, said adapter being provided with an operating section for obtaining a signal responsible for said shared use;

all refrigerating machines suspension commanding means for, when any of said absorption refrigerating machines transmits a signal requiring the suspension of said pump and said signal for said shared use is being obtained, transmitting a command signal to all the other currently operating absorption refrigerating machines from said adapter in order to bring each of said absorption refrigerating machines into a temporary state of requiring said pump to suspend its operation or being capable of suspending the operation of said pump;

temporary state achieving means for achieving said temporary state for all the currently operating absorption refrigerating machines by said command signal and sending out a signal for suspending pumps obtained in said temporary state; and pump suspending means for controlling the suspension of the operation of said pumps after receiving said signal for suspending pumps from each and every one of said absorption refrigerating machines.

2. An absorption refrigerating machines-group apparatus comprising a plurality of absorption refrigerating machines arranged at respective required positions, a remotely arranged control panel and an adapter disposed between said refrigerating machines and said control panel for relaying an operation control signal for controlling the operation of a pump shared by said absorption refrigerating machines of feeding cooling water for cooling respective necessary areas of said absorption refrigerating machines, characterized in that it further comprises:

all refrigerating machines suspension commanding means for, when any of said absorption refrigerating machines transmits a signal requiring the suspension of said pump and a sharing signal is being obtained, transmitting a command signal to all the other currently operating absorption refrigerating machines from said adapter in order to bring each of said absorption refrigerating machines into a temporary state of requiring said pump to suspend its operation or being capable of suspending the operation of said pump;

temporary state achieving means for achieving said temporary state for all the currently operating absorption refrigerating machines by said command signal and sending out a signal for suspending pumps obtained in said temporary state; and pump suspending means for controlling the suspension of the operation of said pumps after receiving said signal for suspending pumps from each and every one of said absorption refrigerating machines.

* * * * *

UNITED STATES PATENT AND TRADEMARK OFFICE

CERTIFICATE OF CORRECTION

PATENT NO. : 5,737,933

DATED : April 14, 1998

INVENTOR(S) : Nobuhiro Idei, et al.

It is certified that error appears in the above-identified patent and that said Letters Patent is hereby corrected as shown below:

Title page, item [75], Inventors, "Yasuo Sakata, Kasukabe" should read --Yasuo Sakata, Kasukabe-shi--.

Column 12, line 55, "temporary control.signal" should read --temporary control signal--.

Signed and Sealed this

Nineteenth Day of October, 1999

*Attest:*

Q. TODD DICKINSON

*Attesting Officer*

*Acting Commissioner of Patents and Trademarks*